US006817679B1

(12) United States Patent
Prieto et al.

(10) Patent No.: US 6,817,679 B1
(45) Date of Patent: Nov. 16, 2004

(54) CORROSION RESISTANT BRIGHT FINISH FOR LIGHT WEIGHT VEHICLE WHEELS

(75) Inventors: Romulo A. Prieto, Northville, MI (US); Ewa Pierz, Pickney, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 602 days.

(21) Appl. No.: 09/731,401

(22) Filed: Dec. 6, 2000

Related U.S. Application Data

(60) Provisional application No. 60/169,417, filed on Dec. 7, 1999.

(51) Int. Cl.[7] ..... B60B 3/00

(52) U.S. Cl. ..... 301/95.101; 301/63.101

(58) Field of Search ..... 301/63.101, 64.701, 301/95.101; 428/411.1

(56) References Cited

U.S. PATENT DOCUMENTS 5,292,182 A * 3/1994 Kanazawa et al. ..... 301/65
5,422,189 A * 6/1995 Warner et al. ..... 428/480
5,491,030 A 2/1996 Asai et al.
5,632,529 A * 5/1997 Wei ..... 301/95.102
5,647,126 A * 7/1997 Wei ..... 29/894.322
5,656,335 A 8/1997 Schwing et al.
5,706,567 A 1/1998 Sakagami et al.
5,792,334 A 8/1998 Asai et al.
6,156,379 A * 12/2000 Terada et al. ..... 427/214
6,158,820 A * 12/2000 Archibald et al. ..... 301/65
6,238,786 B1 * 5/2001 Kaeumle et al. ..... 428/332
6,242,100 B1 * 6/2001 Mokerji ..... 428/412
6,268,060 B1 * 7/2001 Mokerji ..... 428/446
6,440,290 B1 * 8/2002 Vega et al. ..... 205/201
6,607,831 B2 * 8/2003 Ho et al. ..... 428/423.1

OTHER PUBLICATIONS

ZoopSeal Frequently Asked Questions; advertisement; www.performanceunlimited.com/zoopseal; no date.*
Cobra Valley Chemicals, ZoopSeal advertisment; www.performanceunlimited.com/cobravalleychemicals;no date.*

* cited by examiner

*Primary Examiner*—Russell D. Stormer
(74) *Attorney, Agent, or Firm*—MacMillan, Sobanski & Todd, LLC

(57) ABSTRACT

A multiple layered finish for a vehicle wheel surface that includes a first base layer formed from an organic material disposed upon a portion of the wheel surface. The finish also includes a second layer formed form a first inorganic material that covers the base layer and a third layer formed from a second inorganic material disposed over the second layer.

14 Claims, 3 Drawing Sheets

CORROSION RESISTANT BRIGHT FINISH FOR LIGHT WEIGHT VEHICLE WHEELS

CROSS REFERENCE TO RELATED APPLICATIONS

This application claims the benefit of U.S. Provisional Application No. 60/169,417, filed on Dec. 7, 1999.

BACKGROUND OF THE INVENTION

This invention relates in general to light weight vehicle wheels and in particular to a surface finish for a light weight vehicle wheel and a process for forming the surface finish.

Vehicle wheels include a circular wheel disc which can be formed across an is end of an annular wheel rim. Alternatively, the wheel disc can be recessed within the wheel rim. The wheel disc includes a wheel hub having a central pilot hole and a plurality of wheel stud holes formed therethrough for mounting the wheel upon a vehicle. Typically, the wheel disc also includes a plurality of wheel spokes connecting the wheel hub to the rim.

In the past, vehicle wheels have traditionally been fabricated by attaching a stamped steel disc to a rolled steel rim. Vehicle wheels also have been cast or forged from steel billets. Increasingly, vehicle wheels are being formed from light weight metals, such as aluminum, magnesium, titanium, or alloys thereof. Such light weight metal wheels can be cast or forged as a one-piece wheel or assembled by attaching a full or partial wheel disc to a wheel rim. Additionally, bimetal wheels can be assembled from a wheel disc and rim formed from dissimilar metals. For example, a cast aluminum alloy full face wheel disc can be welded to a partial wheel rim rolled from a strip of steel.

With all wheels, regardless of the material used to form the wheel, the outer surface of the wheel disc is visible when the wheel is mounted upon a car. Accordingly, the wheel disc can be formed having a pleasing aesthetic shape. The wheel disc outer surface is then typically machined to form a smooth surface which is subsequently provided with a surface finish which usually has a decorative high luster.

One type of surface finish, which is used extensively, is formed by chrome plating the outer surface of the wheel disc. During chrome plating, a layer of chromium, which can be polished to a high luster, is deposited upon the wheel surface. Known methods for forming a surface layer of chromium on a wheel surface are complex and typically require a number of discrete steps involving chemical deposition of multiple layers of metal onto the surface.

A typical method for chrome plating a wheel is illustrated in the flow chart shown in FIG. 1. In functional block 10, a formed wheel that has been machined to final shape is provided. As shown in block 11, the wheel is prepared for chrome plating by first immersing the wheel in a solvent bath. The solvent bath removes oils and dirt, which would inhibit adhesion of metal deposits to the wheel surface. The wheel, in functional block 12, is pretreated by immersion in a chemical bath to dissolve any surface oxides. This further improves the adhesion of metal deposits to the wheel surface. The wheel is then rinsed, as shown in functional block 13, by immersion in a water bath or spraying with a high pressure water jet. The preparatory steps of removing oil and dirt, dissolving surface oxides and flushing are typically referred to as cleaning the wheel surface.

The chrome plating process begins in functional block 14 with the immersion of the portion of the wheel to be chrome plated in a chemical bath containing nickel in solution.

During immersion, a thin layer of nickel, referred to as a prenickel layer, is chemically deposited upon the wheel surface to enhance adhesion of successive metal layers thereto. This prenickel layer tends to have a relatively uneven surface. Accordingly, in functional block 15, a copper layer is chemically deposited, usually by immersion of the wheel surface in another chemical bath which contains copper in solution, over the prenickel layer. The copper layer fills in uneven portions of the prenickel layer, forming a smooth surface. To further enhance the surface smoothness, the copper layer is buffed, as shown in functional block 16. In functional block 17, a second nickel layer, referred to as a semibright nickel layer, is formed by chemical deposition over the buffed copper layer. The semibright nickel layer provides corrosion resistance. Next, in functional block 18, a layer of nickel containing sulfur is chemically deposited over the semibright nickel layer as a sacrificial corrosion layer. In functional block 19, a final bright nickel layer is deposited onto the surface to provide reflectivity and brightness to the wheel surface.

The layers of nickel and copper provide a base upon which the chromium layer is deposited. In functional block 20, a prechromium layer is deposited ever the bright nickel layer. This layer is formed from discontinuous chrome, or pixy dust, to provide a more durable surface layer. Finally, in functional block 21, a layer of chromium is deposited to prevent nickel fogging.

During the chrome plating process, each successive metal layer is typically formed by immersing the portion of the wheel surface to be chrome plated in a chemical bath containing a solution of the particular metal to be deposited on the wheel surface. Thus, each layer is chemically bonded to the preceding layer to provide a durable and attractive decorative surface coating on the wheel. Known methods for forming other types of wheel surface finishes are similar to the above described chrome plating process and typically include a number of discrete steps.

SUMMARY OF THE INVENTION

This invention relates to a surface finish for a light weight vehicle wheel and a process for forming the surface finish.

As explained above, it is desirable to apply an attractive and durable surface finish to vehicle wheels. One known method involves chrome plating the wheel however, as described above, the chrome plating process is complex, and hence time consuming and costly. Additionally, the many steps involved increase the potential for defects in the surface finish which would cause the wheel to be scrapped.

Accordingly, a simpler method for forming a decorative finish upon a vehicle wheel surface would be desirable.

The present invention contemplates a process for forming a finish upon a vehicle wheel which includes depositing a base layer formed from an organic material onto at least a portion of a surface of the vehicle wheel. The base layer of organic material is then cured. A first finish layer formed from a first inorganic material is deposited over the organic base layer and a second finish layer formed from a second inorganic material is deposited over the first inorganic layer. The invention also contemplates cleaning the surface of the wheel before depositing the base layer of organic material onto the wheel surface. The cleaning of the surface of wheel may form an optional intermediate layer of material between the surface of the wheel and the base layer of organic material.

It is further contemplated that the first inorganic layer can include a color. Additionally, or alternately, the first inorganic layer can include a metallic or a ceramic material while the second inorganic layer can include a ceramic; clear coat.

The invention also contemplates a vehicle wheel having an annular wheel rim and a circular wheel disc formed across an end of the wheel rim. A first layer formed from an organic material is disposed over at least a portion of a surface of either the wheel rim or the wheel disc. A second layer formed from a first inorganic material is disposed over the first layer formed from an organic material and a thin layer formed from a second inorganic material is disposed over the second layer formed from an inorganic material. The wheel may optionally include an intermediate layer disposed between the surface of the wheel and the first layer of organic material.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
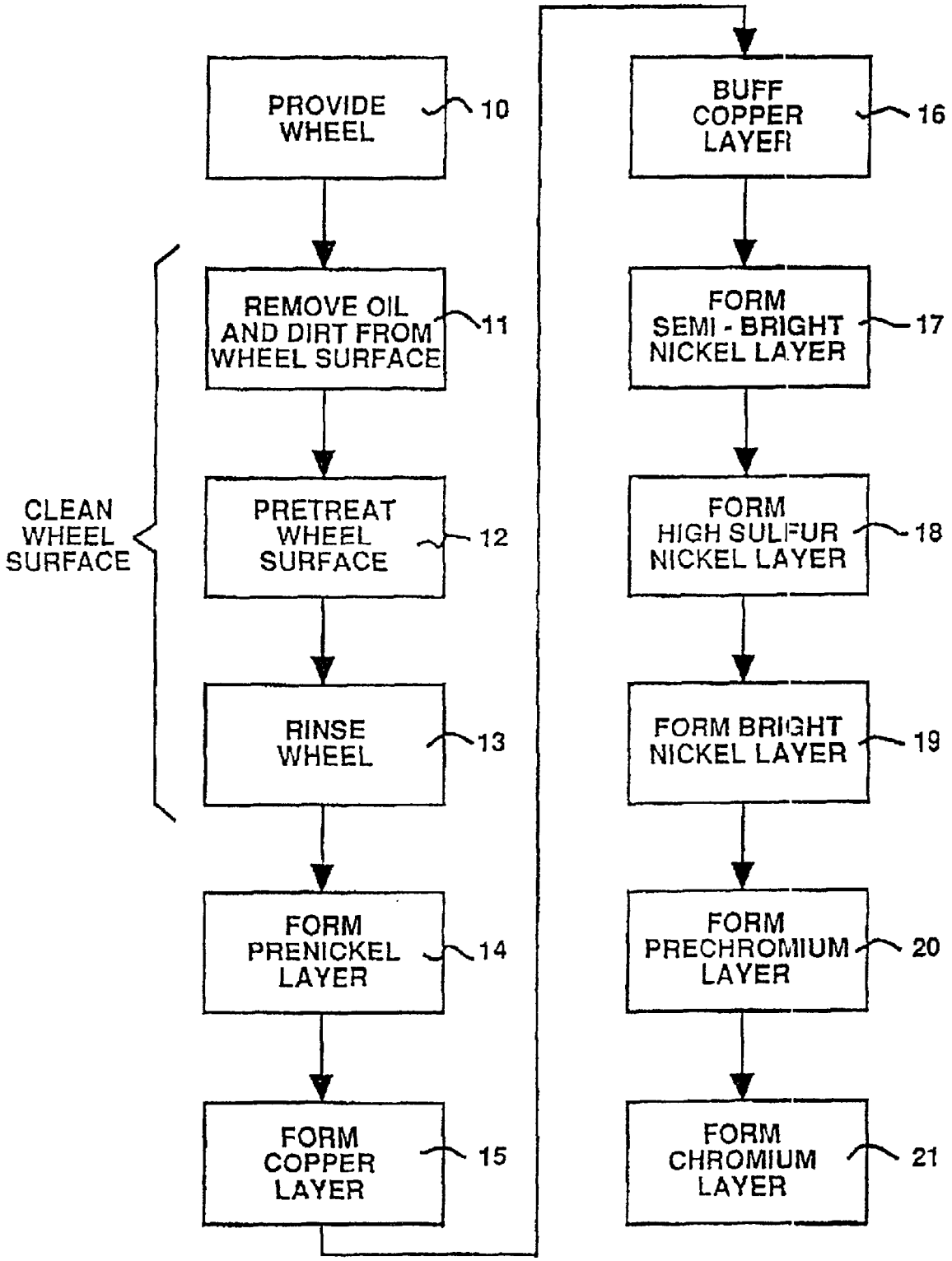
FIG. 1 (PRIOR ART)
FIG. 1 is flow chart illustrating a known process for chrome plating a vehicle wheel.
Figure 2:
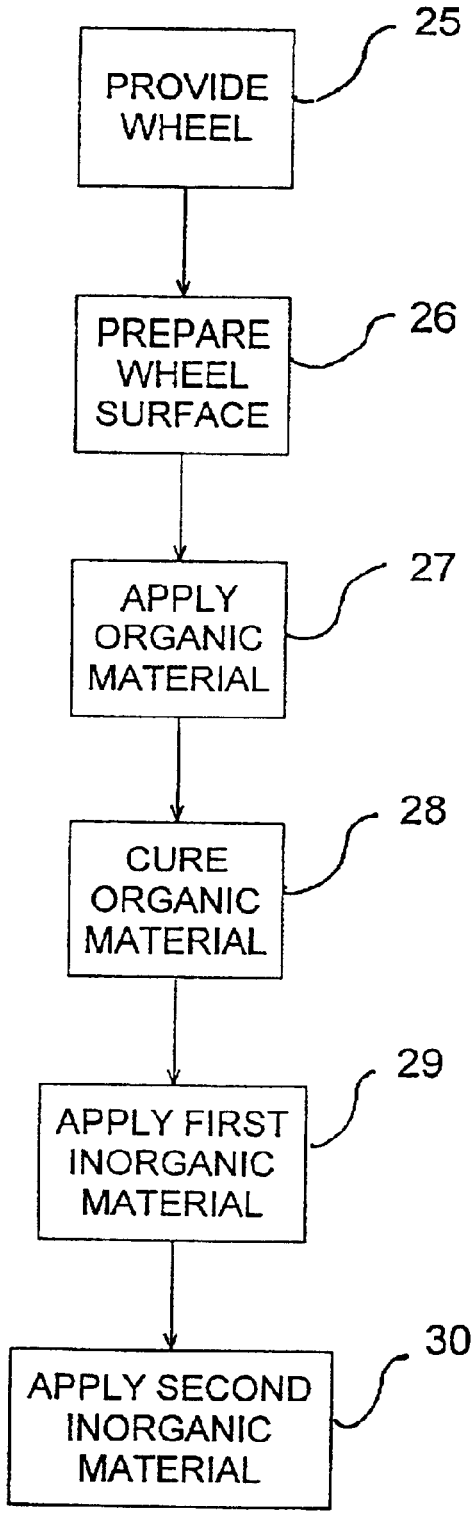
FIG. 2 is a flow chart illustrating a process for forming a finish con wheel surface in accordance with the invention.

Referring again to the drawings, there is illustrated in FIG. 2, an improved process for forming a surface finish upon a vehicle wheel. In functional block 25, a vehicle wheel is provided. The vehicle wheel can be a one piece or a multi-piece wheel which is formed by a conventional process such as casting, forging, stamping or rolling. In the preferred embodiment, the wheel is formed from an alloy of a light weight metal such as aluminum, magnesium or titanium; however, it will be appreciated that the wheel also can be formed from steel. Additionally, the wheel can be formed from two different metals.

The wheel is subjected to a conventional cleaning process in functional block 26 to remove any grease or dirt from the surface thereof.

A base coating of an organic material is applied to at least a portion of a surface of the wheel in functional block 27 to form a base layer. It is contemplated that any number of organic materials can be used, such as, for example, a polymer, resin, acrylic, epoxy, urethane, paint, or a combination of the materials. In the preferred embodiment, a powder which includes an organic resin compound is sprayed onto an electrostatically charged surface of the wheel while the wheel is rotated. Alternately, the entire surface of the wheel can be sprayed in functional block 27. The wheel is then heated in a curing oven at a predetermined temperature for a predetermined time period in functional block 28 to cure the organic material and thereby form an organic base coating upon the wheel surface. The organic base layer fills any surface irregularities to ensure that any rough surfaces which may remain upon wheel surface after machining are smoothed over.

A first inorganic material is applied over the organic base layer in functional block 29 to form a first inorganic layer. The material and process used to apply the material is selected to provide a desired surface finish. For example, a metallic material such as chromium can be applied to form a highly lustrous surface finish. Alternately, other metallic materials such as aluminum, titanium, silver and gold can be applied to provide different colors for the finish. It is also contemplated that a ceramic can be used for the first inorganic layer. Thus, an inorganic layer of a ceramic clear coat could be applied over an organic base layer of paint to allow the paint color to be visible. In the preferred embodiment, the wheel is placed in a vacuum chamber and a glow discharge triggered to create a plasma. The metallic material is vaporized in the plasma and then deposited onto the surface of the wheel. The metallic material also can be applied by means of an arc vaporizer, a laser vaporizer or by single or double cathode sputtering.

A second inorganic material is applied over the first inorganic layer in functional block 30 to form a second inorganic layer. The second inorganic material is applied by one of the processes described above for applying the first inorganic layer. In the preferred embodiment, a layer of ceramic clear coat is applied to the wheel surface to form the second inorganic layer. The ceramic clear coat forms a protective coating over the lustrous first inorganic layer.

Figure 3:
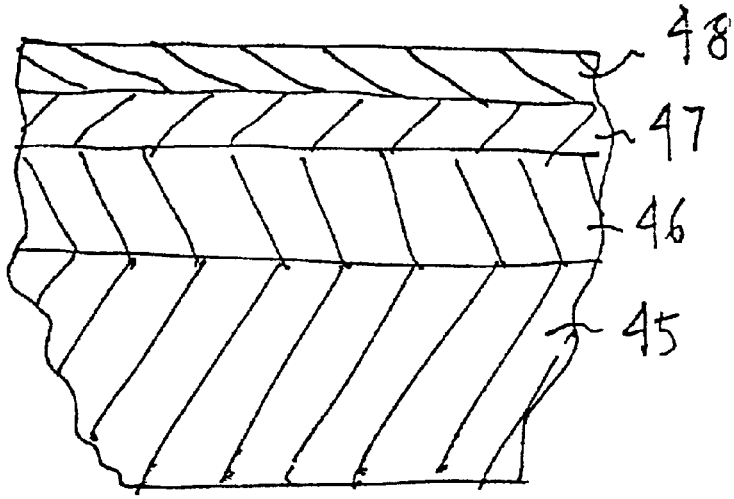
FIG. 3 is a fragmentary sectional view of a vehicle wheel which has been finished by the process illustrated in FIG. 2.

The present invention also contemplates a wheel having a surface coating formed by the above described process. A fragmentary sectional view a portion of such a wheel 45 is shown in FIG. 3. As described above, the wheel 45 is formed by a conventional process from steel or an alloy of a light weight metal. A base layer of organic material 46 is disposed over a portion of a surface of the wheel. A first layer of inorganic material 47 covers the organic layer 46. A second layer of inorganic material 48 covers the first layer of inorganic material 47. In the preferred embodiment, the inorganic layers 47 and 48 are thinner than the organic base layer 46.

Figure 4:
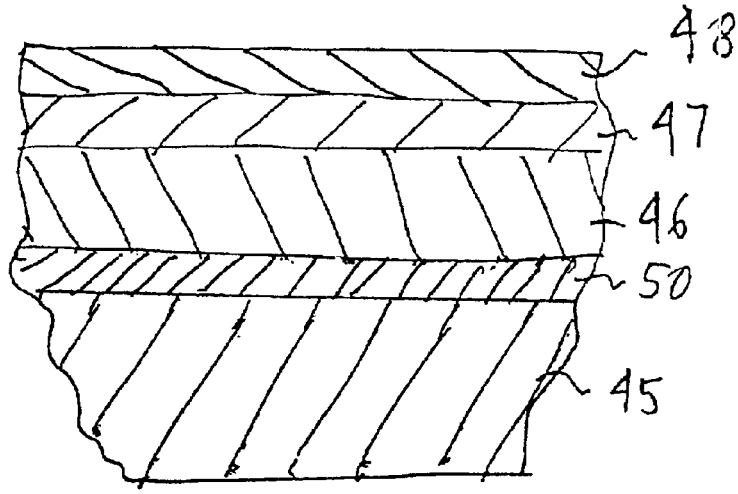
FIG. 4 is a fragmentary sectional view of an alternate embodiment of a vehicle heel which has been finished by the process illustrated in FIG. 2.

An alternate embodiment of the invention is illustrated in FIG. 4 where a layer of pretreatment material 50 is included between the surface of the wheel 45 and the organic base layer 46. Components in FIG. 4 which are similar to components shown in FIG. 3 have the same numerical designators. The pretreatment layer 50 can result from the specific processes used to prepare the wheel for surface coating. For example, the cleaning of an aluminum wheel may result in a layer of aluminum oxide being formed upon the surface of the wheel 45. The base layer 46 formed from an organic material is applied over the aluminum oxide layer. As described above, two additional layers 47 and 48 are then formed from inorganic materials over the base layer 46.

It is expected that the invention will provide a number of advantages over prior art wheel surface finishes. Included in the advantages are a bright surface appearance and a possibility of different colors for the surface finish. Also, the present invention provides both a high resistance to corrosion of the wheel surface and a lowered adherence of brake dust to the surface of the wheel. Additionally, the inventors expect that the inorganic material is harder than prior art surfaces, which will enhance the durability of the surface finish in car washes.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope. For example, while the preferred embodiments have been illustrated and described as including three or four layers of material, it will be appreciated that additional layers of material can be applied to the wheel. Thus, two layers of lustrous material can be applied between the base layer and the protective clear layer to provide a deeper shine to the wheel surface. Additionally, while in the preferred embodiment different inorganic materials are used are used for the first and second inorganic layers, it is also contemplated that the two inorganic layers can be formed from the same inorganic material.

What is claimed is:

1. A vehicle wheel comprising:

an annular wheel rim;

a circular wheel disc formed across an end of said wheel rim;

a first layer formed from a cured organic material disposed over at least a portion of a surface of one of said wheel rim and said wheel disc;

a second layer formed from a first inorganic material disposed over said first layer, and a third layer formed from a second inorganic material disposed over said second layer.

2. A vehicle wheel according to claim 1 wherein said first inorganic material includes a metallic material.

3. A vehicle wheel according to claim 2 wherein said second inorganic material includes a ceramic clear coat.

4. A vehicle wheel according to claim 1 wherein said first inorganic material includes a ceramic material.

5. A vehicle wheel according to claim 4 wherein said third layer formed from said second inorganic material includes a single layer of a ceramic clear coat.

6. A vehicle wheel according to claim 1 wherein said organic material in said first layer includes a color.

7. A vehicle wheel according to claim 1 wherein the second inorganic material is the same as the first inorganic material.

8. A vehicle wheel according to claim 1 wherein the second inorganic material is different from the first inorganic material.

9. A vehicle wheel according to claim 1 further including an intermediate layer formed from an inorganic material disposed between the surface of the wheel and said first layer of cured organic material.

10. A vehicle wheel according to claim 9 wherein the wheel is formed from an aluminum alloy and further wherein said intermediate layer disposed between said surface of the wheel and said first layer includes aluminum oxide.

11. A vehicle wheel according to claim 1 wherein said first layer of organic material includes one of a polymer, a resin, an acrylic, an epoxy and urethane and a paint.

12. A vehicle wheel according to claim 11 wherein said second layer includes one of chromium, aluminum, titanium, silver and gold.

13. A vehicle wheel according to claim 12 wherein said third layer includes a single layer of a ceramic and a clear coat.

14. A finish for a surface of a vehicle wheel disc comprising:

a first layer formed from an inorganic material disposed over at least a portion of a surface of the wheel disc;

a second layer formed from a cured organic material disposed over said first layer;

a third layer formed from a first inorganic material disposed over said second layer; and a fourth layer formed from a second inorganic material disposed over said third layer.

* * * * *